US005704404A

United States Patent [19]

Balding, Jr. et al.

[11] Patent Number: 5,704,404

[45] Date of Patent: Jan. 6, 1998

[54] METHOD AND DEVICE FOR COMPACTING RESILIENT WASTE MATERIALS FOR STORAGE AND DISPOSAL

[76] Inventors: William E. Balding, Jr., 6236 Harrison, Hammond, Ind. 46234; Joseph A. Crowley, 1222 E. 168th St., South Holland, Ill. 60473

[21] Appl. No.: 506,551

[22] Filed: Jul. 25, 1995

[51] Int. Cl.[6] ..... B65B 1/04

[52] U.S. Cl. ..... 141/80; 141/12; 100/220; 53/436; 53/475; 53/527

[58] Field of Search ..... 141/12, 71, 73, 141/80; 100/220; 220/524, 525, 526; 206/499, 508; 53/436, 475, 527, 526, 244

[56] References Cited

U.S. PATENT DOCUMENTS

| | | | |
|---|---|---|---|
| 2,713,423 | 7/1955 | Russell | 53/526 |
| 2,751,073 | 6/1956 | Sheeran | 206/46 |
| 2,828,886 | 4/1958 | Thomas | 220/93 |
| 3,455,345 | 7/1969 | Parker, Jr. | 141/12 |
| 3,924,774 | 12/1975 | Donnelly | 220/93 |
| 4,414,788 | 11/1983 | Berg | 206/499 |
| 4,462,310 | 7/1984 | Jackson et al. | 100/219 |
| 4,564,469 | 1/1986 | Cochet et al. | 252/626 |
| 4,625,883 | 12/1986 | Burke et al. | 220/93 |
| 4,760,784 | 8/1988 | Whiteside | 100/220 |
| 4,777,874 | 10/1988 | Manning | 100/220 |
| 4,876,955 | 10/1989 | Jackson | 100/219 |

*Primary Examiner*—Henry J. Recla
*Assistant Examiner*—Steven O. Douglas
*Attorney, Agent, or Firm*—Ladas & Parry

[57] ABSTRACT

A method and device is disclosed for compacting resilient waste materials for storage and disposal. The device provides for a storage container having at least one group of retaining members secured to the interior surface of the sides. Each group of retaining members is generally coplanar with the bottom of the container and each group defines the top of one of a plurality of storage zones located within the interior of the container. One or more domed caps are provided which are dimensioned to slidingly fit within the container and to cover the top of each storage zone. Finally, there is structure located on the edge of each domed cap for engaging the retaining members when a domed cap is placed on the top of the waste materials and compacted below a group of retaining members defining the top of a storage zone. There is also disclosed a method for compacting resilient waste materials for storage and disposal using the device of the invention.

23 Claims, 5 Drawing Sheets

METHOD AND DEVICE FOR COMPACTING RESILIENT WASTE MATERIALS FOR STORAGE AND DISPOSAL

BACKGROUND OF THE INVENTION

1. Field of the Invention

The present invention relates to economical waste storage and disposal devices and methods for employing the same.

As larger quantities of waste are produced each year by individual and corporate or commercial users of goods, it has become more difficult to find locations such as landfills for disposing of such wastes. Environmental and economic concerns of every description come to the forefront when old landfills become full or new sites are proposed.

Various methods to reduce the volume of wastes have been contemplated and even implemented. For example, federally funded, locally funded, and for profit recycling projects have sprung up all over the United States with varying degrees of success. Solid wastes are separated from combustible wastes and recycled or put into use in some other form such as when tires are shredded and used in paving and athletic field applications. Combustible wastes may be disposed of by incineration, provided Federal guidelines are adhered to such as the Clean Air Act and the like.

In spite of all of these efforts, certain wastes simply do not lend themselves to recycling, reuse or combustion. Radioactive contaminated wastes, for example, must be stored for long periods of time in remote dump sites or landfills until the radiation levels have diminished to acceptable handling and disposal levels.

Available landfills for commonplace garbage from municipalities are quickly becoming full. To solve this problem, landfillable wastes are being shipped across state lines; in some instances even to sites many states away which will still receive the wastes. However, many communities currently are vigorously lobbying against having any further development of waste sites in their areas.

Similarly, radioactive waste sites are becoming full. Communities which once allowed these sites to operate are now resisting any further development in a far more aggressive manner. This problem is further amplified by the fact that an ever increasing amount of radioactive waste is being produced while existing sites for storing such wastes are full and no new sites are being made available for the disposal or storage of these wastes. Accordingly, the need arises whereby current users of the radioactive waste sites must strive to maximize the volume of such radioactive waste per unit volume. This principle also applies to common household waste, medical wastes and any wastes which may be compactable. Numerous methods disclosed in the prior art have attempted to address the problem of waste compaction of general wastes and even low level radioactive wastes.

The teachings of the art clearly are concerned with compaction, but contain numerous disadvantages from the standpoint of ease of use, economy of implementation, economy of use, product, and viability in actual operation.

2. Description of the Related Art

When compacting material, it is desirable to leave material indefinitely in the container as the case with low level radioactive wastes. This has generally been accomplished by placing material in 55 gallon drums and burying or storing them.

The cost of such disposal is generally based on volume and weight making it advantageous to achieve as high a final compacted density as possible. Unfortunately, a problem often arises when loading waste materials into disposal containers and compacting the materials. As soon as the compacting force is removed from the material, the material springs back, thus, decreasing the final compacted density. Several devices have attempted to solve this problem in order to achieve high final compacted density.

U.S. Pat. No. 4,777,874 to Manning discloses a container used for compacting materials which has a device used to keep the compacted material from springing out of the container when the compacting force is removed. The device includes a louvre attached to the container, enabling cross beams to be snapped into place with a wedge shape on the cross beam ends. Although the strength of the design can retain higher spring back pressures, the device is cumbersome as it requires very specialized placement of the cross beams and louvres and it also requires a means for deformation of the container in order to engage the cross beams below the louvres.

U.S. Pat. No. 4,564,469 to Cochet, et al. discloses a process and an apparatus for storing contaminated waste material by compacting. Waste material is placed in a drum and is compressed by forcing a precover into the drum. The precover includes edges which are made deformable in order to prevent the rising of the precover, by its edges locking on the walls of the drum. The specification notes that an adequate locking can be obtained by the mere friction of the edges of the precover on the lateral wall of the drum.

U.S. Pat. No. 4,760,784 to Whiteside discloses a compacting plate locking device used for packaging expansible material. The device includes compacting plates adapted to fit within a barrel or similar container. A plurality of resilient locking tabs are secured to the upper surface of the compacting plates by means of an angle bracket such that the tabs extend beyond both the peripheral surface of the compacting plate and the outermost edge of the angle bracket. The arrangement of the locking tabs and angle brackets provides for engagement of the tabs within the inside of the container. As the compacting plate is inserted into the container, the locking tabs are deformed and become wedged between the outer surface of the angle brackets and the inside surface of the container. The specification notes that the resulting effected wedging of locking tabs forms an effective frictional stop between the compacting plate and the inside surface of the container.

The inventions in Cochet and Whiteside both depend upon an essentially frictional force to counter spring back effect in the compacted waste materials. One skilled in the art would appreciate the limitations of resisting spring back from compacted materials with frictional forces. Depending on the coefficient of friction of the surfaces in contact, the resisting force available to counter spring back may vary greatly. When the inner surface of a container is contaminated with oil or grease, the frictional force available to resist compacted material spring back may be unsatisfactorily low.

For the foregoing reasons, there is a need for a method and device for compacting resilient waste materials for storage and disposal that does not depend on an arbitrary frictional force to resist considerable spring back from compacted waste materials. Furthermore, there is a need in the art for a method and device for compacting waste materials that does not require deformation of the waste container.

SUMMARY OF THE INVENTION

The present invention is directed to a method and device for compacting resilient waste materials for storage and disposal that satisfies the need for economical waste storage and disposal devices and methods that maximize final compacted density. The present invention overcomes the drawbacks noted in the prior art by providing a method and device that use a mechanical rather than a frictional locking action to resist spring back from compacted waste. Furthermore, the present invention meets the needs in the art without the requirement of external means for engaging the locking mechanism.

It is an object of the device of the invention to maximize the final density of compacted waste. The device comprises a storage container having a bottom, elongated sides, and an open top. There are groups of retaining members secured to the interior surface of the sides of the container. Each group of retaining members is positioned so that at the point of contact with the storage container, the retaining members are generally coplanar with the bottom of the container. Storage zones, horizontal stroage zones in the instance of a vertically filled container, are created in the storage containers by including the retaining members in the containers at various intervals thus creating storage zones which are stacked (vertically) within the containers. The top or end of each storage zone is generally defined by a group of retaining members. Domed caps are also provided which are dimensioned to slidingly fit within the storage container and define the top of each storage zone. Means are located on the outer edge of the domed caps for engaging the retaining members.

The retaining members may be provided in any number of a series of designs including individual retaining members. Individual retaining members may be attachably mounted to the storage device by securing the mounting plate portion of the retaining member to the inside portion of the elongated sides of the container in a series generally coplanar to the bottom of the storage device. The retaining member has a downwardly mounted tab which is provided at an angle of 90° or less from the perpendicular plane of the mounting plate toward the bottom of the barrel. The inside angle created by the mounting plate and the downwardly mounted tab provides a positive mechanical lock when it engages the complementary upward and outward lip of a domed cap.

The retaining clips may also be provided as part of a ringed formation. The ringed formation consists of a generally circular (in the case of a circular barrel or drum) member defined by an outside and inside portion of the ring wherein the outside portion conforms to the inside geometry of the storage device to provide a snug fit in said device. The inside portion of the ring may have retaining clips secured thereto in order to provide the mechanical lock with the upward and outward lip of the domed cap.

The ring is securely attached to the inside of the storage device by any suitable means including welding, bonding by gluing, or any other means suitable in accordance with the material of the barrel and the ring. When attached, the ring should be positioned such that it is coplanar to the bottom of the storage device and capable of defining one of many storage zones.

In another embodiment, the ring may be attachably secured within one of coves of the storage device when a barrel or any such familiar device is used, the cove being defined hereinbelow. The downwardly extending retaining clips project into the storage device from the ring from which they are secured out of the cove at an angle and distance so as to provide a positive, opposite mechanical force to lock the domed lid in place.

In line with the individual retaining members discussed above, retaining members having springably mounted downward facing tabs are also contemplated. These retaining members would also be securely mounted within the storage device by attaching the mounting plate to the interior side walls of the storage device in an configuration generally coplanar to the bottom of the device. A series of horizontal zones would thus be defined. These springable tabs might also be part of a ring forming retaining mechanism.

The feature of providing a springable tab might be advantageous in the instance where denser, less easily compactable wastes are provided. As compaction forces might be greater with less easily compactable materials, the spring mechanism included in the retaining clips would aid in lessening of any possible shearing of the retaining members from the storage device during compaction.

In another embodiment, the retaining members either individually or in a ringed form may be attached to the storage container prior to the container being formed. For example, prior to the formation of a container, especially when the container is rolled into its final configuration from flat stock, the retaining means may be attachably secured to the flat stock.

The storage container defined herein is preferably cylindrical and can be a drum such as a conventional 55 gallon drum commonly used to store and ship goods including liquids, solids etc. These drums are generally noted to have interior horizontal coves. The retaining members may be positioned adjacent to these coves or in the coves themselves when presented in preferred embodiments as disclosed herein. Preferably, the retaining members are downwardly angled tabs. The retaining members may also be mounted on a rigid wire form that conforms to the inner configuration of the storage container and is secured to the interior of the container. Means are located on the edge of domed caps for engaging the retaining members. These means are preferably presented in an upwardly and outwardly angled lip. The domed cap is constructed of a resilient material such as steel or a deformable resilient plastic such as polyvinyl chloride styrene, polystyrene, ABS plastic or the like so that lateral expansion can occur when the convex dome is depressed. The domed cap may contain vents, the purpose among many contemplated to relieve pressure on the domed device.

In another embodiment, there is provided a sleeve or similar type of device which would attachably mount to a conventional compacting ram. The sleeve defined having two opposite ends. The first end conforming to the geometry of the ram so the sleeve can be secured to the ram. The second end, opposite to the first, would be molded to substantially conform to the domed cap thus providing an even distribution of downward force exerted by the ram to ensure a positive, even compaction of waste material in the storage container. Furthermore, the second end would assist in preventing the domed cap from deforming under uneven compaction pressures.

The invention also comprises a method for compacting resilient waste material for storage and disposal. The method comprises the steps of:

- securing at least one group of retaining members to the interior surface of the sides of a storage container, positioning each group of retaining members generally coplanar with the bottom of the container thereby forming storage zones;
- filling the lowest unfilled storage zone of the container with waste materials, the top of each storage zone being defined by a group of retaining members;
- compacting the waste materials;
- placing a domed cap on the top of the compacted materials;

compressing the domed cap until it is below the group of retaining members defining the top of the filled zone;

releasing the pressure on the domed cap whereby the cap engages on the retaining members at the top of the filled storage zone; and repeating the steps of the process until an entire storage container is filled with compacted waste materials.

The method and device of the invention have many advantages over the prior art. Most significantly, the mechanical locking action of the retaining members and domed cap provides a substantial resisting force to counter spring back from material subject to high pressure compacting. The simplicity and versatility of design lends itself to inexpensive methods of manufacturing the components. For instance, the domed caps can be made of relatively inexpensive materials or recyclable materials. Also, the waste compacting system is a self-contained system that requires no additional external apparatus; therefore, no substantial change to existing compacting operations is necessary. The retaining members are a very inexpensive means by which to create a positive locking mechanical device as inexpensive materials can be used to manufacture the retaining members and installation is relatively simple.

BRIEF DESCRIPTION OF THE DRAWINGS

These and other features, aspects, and advantages of the device and method of the present invention will become better understood with regard to the following description, appended claims, and accompanying drawings where:

In drawings, like parts have like numbers.

DESCRIPTION OF THE PREFERRED EMBODIMENTS

Figure 1:
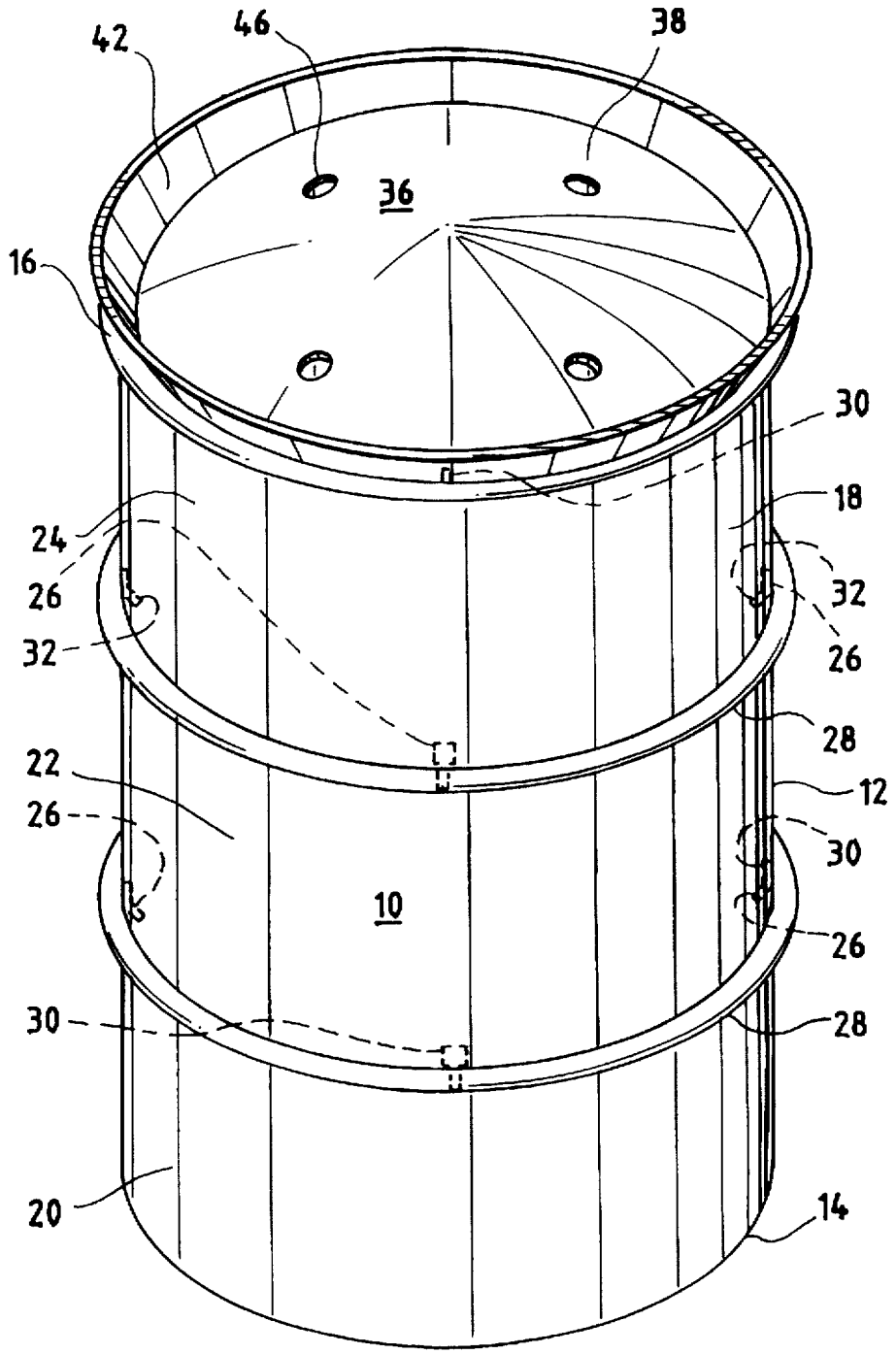
FIG. 1 is a vertical perspective view of the storage device of the invention showing the vertical container and domed cap usable therewith.

With specific reference to the drawings, there is shown in FIG. 1 a drum 10. This drum is configured to resemble the construction of a typical commercially available 55 gallon storage drum of the type used to store and transport liquids, solids and the like. It has a cylindrical side 12, a bottom 14 and top 16.

The interior 18 of the drum 10 is divided into a series of horizontal zones, numbered in FIG. 1 from the bottom 14 of the interior 18 to the top 16 of the drum 10 by the numerals 20, 22 and 24 respectively. This arrangement provides a series of vertically stacked spaces. The top of each zone is generally defined by several retaining members 26 which are attached to the sides 12 of the interior 18 of the drum in a pattern of equally spaced apart circumferential rings located just above the horizontal coves 28 which extend around the circumference of the drum.

Figure 2:
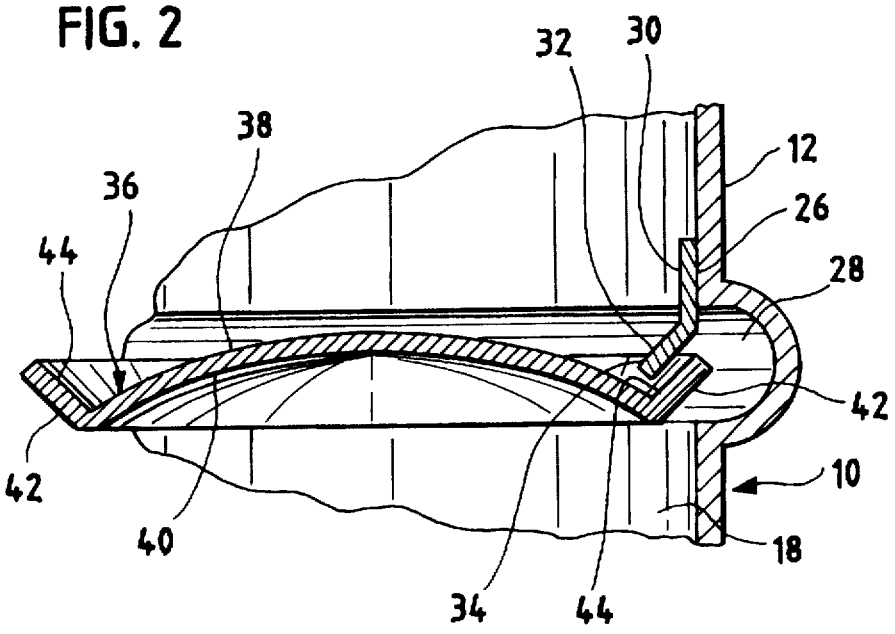
FIG. 2 is a partial vertical view cut away showing the domed cap being locked by the retaining members.

The detail of a typical retaining member 26 is shown in FIG. 2. It consists of a vertical mounting plate 30 which is preferably constructed of a metal such as steel or any material which may be attachably fastened to the interior surface of the drum and is securably attached by suitable means depending on the material of the barrel such as welding, bonding or the like to the interior of the sides 12. Fitted to the mounting plate 30 is a downwardly mounted tab 32 terminating in an open or engaging end 34. The tabs 32 may be in the form of small plates or pins.

Figure 9:
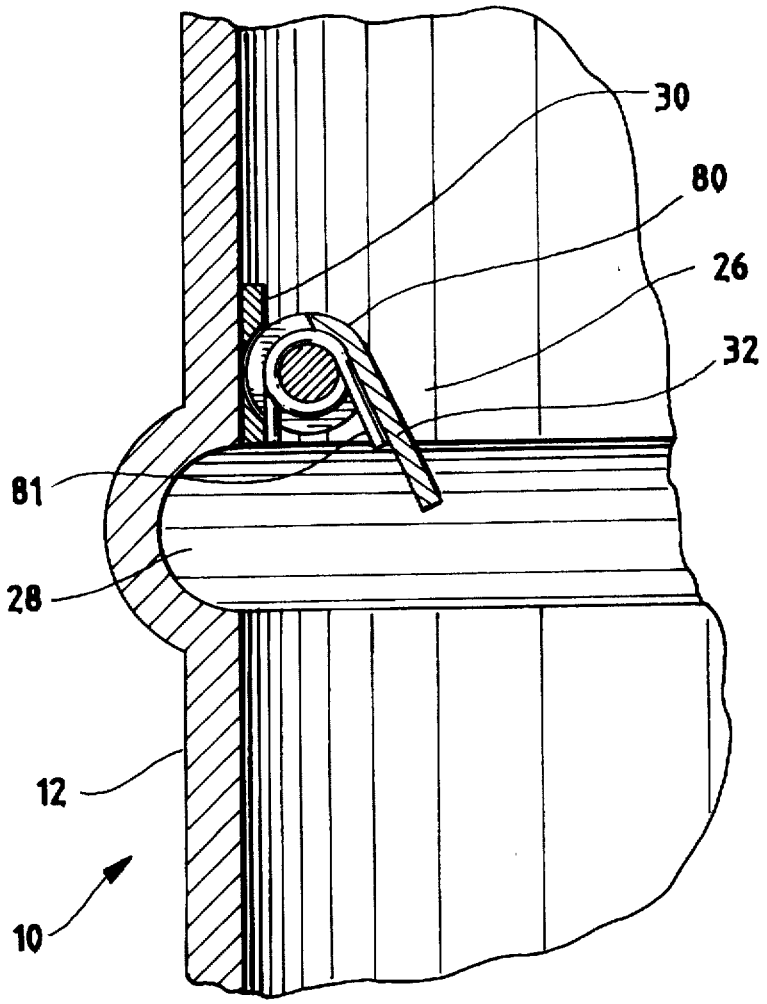
FIG. 9 is a partial vertical view cutaway showing a retaining member with a spring loaded tab.

The detail of another embodiment of a retaining member 26 is shown in FIG. 9. It consists of a vertical mounting plate 30 which is attached to the interior of the sides 12 as described above. Fitted to the mounting plate 30 is a hinged knuckle 80 that is attached to a downward facing tab 32. A spring 81, such as a torsion spring (shown), flat spring, brush spring, or the like, is engagingly disposed between the tab 32 and the side 12, thereby providing for a springable tab. The springable tabs of FIG. 9 may also be mounted on a ring forming mechanism as described hereinabove. Springable tabs may also be implemented in further embodiment without a separate spring as it is possible to design a tab 32 that springs back without the need for a hinge and spring.

Figure 3:
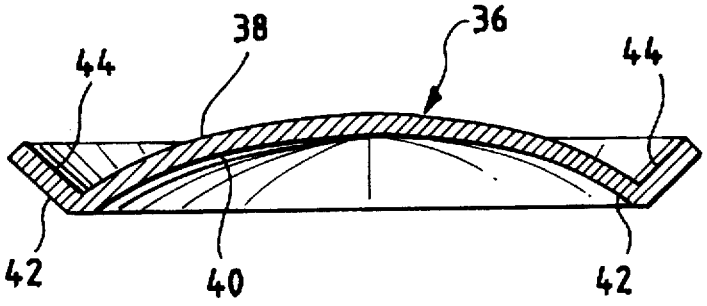
FIG. 3 is a horizontal cut away view of the domed cap usable in the practice of the invention.

For each horizontal zone, there is provided a domed cap designated generally by the numeral 36. It has a concave top 38 and a corresponding convex bottom 40. The domed caps are constructed of a material, such as steel or other resilient material selected from commonly employed durable plastics as mentioned above that produces a horizontal deflection of the cap when the convex dome is depressed. Fitted about the circumference of the domed cap is lip 42 which as shown in FIGS. 1, 2 and 3 is angled upwardly and outwardly. As is clear from FIG. 2, the inside 44 of the lip 42 is sized to receive tabs 32. The domed caps 36 are dimensioned so lip 42 slidably engages the tabs 32 of the retaining members 26 thus allowing the domed caps to be positioned within the top portion of the horizontal zones 20, 22 and 24. Optionally, the domed caps 36 may contain vent holes 46.

Figure 4:
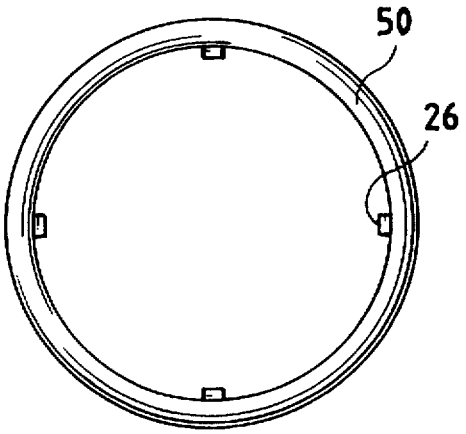
FIG. 4 is a top view of a wire form having retaining members mounted on the surface.
Figure 5:
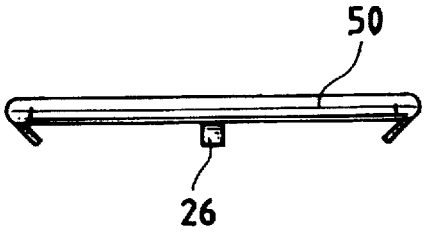
FIG. 5 is a side view of a wire form having retaining members mounted on the surface.
Figure 6:
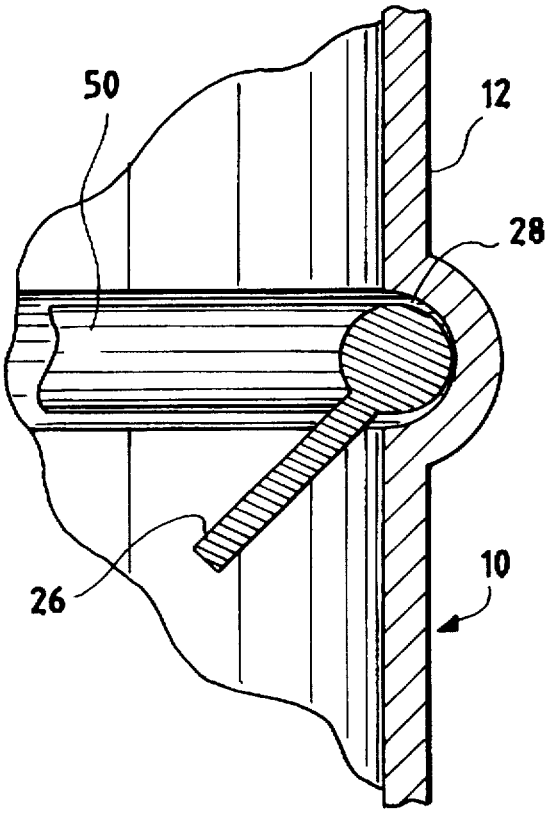
FIG. 6 is a partial vertical view cut away showing the wire form positioned in a horizontal cove of a vertical container.

In another embodiment of the device, the retaining members 26 are secured to a wire form 50 as depicted in FIGS. 4, 5 and 6. The wire form 50 is configured to be complementary to the dimensions of the interior 18 of drum 10. The wire form 50 is then secured to the inner surface of the sides 12. The wire form 50 may be secured to the sides 12 by means such as welding or in another embodiment, the wire form 50 is secured in the horizontal cove 28 of drum 10 as shown in FIG. 6.

Figure 7:
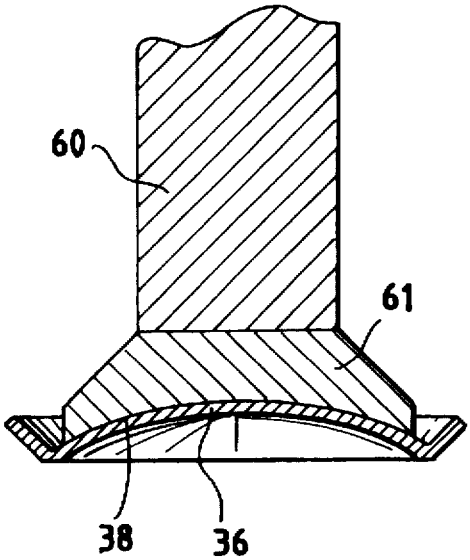
FIG. 7 is a horizontal cutaway view of a domed cap and a ram having a head with a configuration complementary to the domed cap.

The method of the invention can also be described by reference to the Figures. Waste material is loaded into a drum and compacted by means of a ram 60, shown in FIG. 7. In a preferred embodiment, the ram has a head 61 with a configuration complementary to the top 38 of the domed cap 36. The waste material is compacted to a point at which the material's maximum compactability is lower than the lowest group of retaining members 26. With reference to FIG. 1, it can be seen that the initial load of waste materials would have to be compacted below the retaining members 26 immediately above horizontal storage zone 20.

Ram pressure is then released and a domed cap 36 is placed on top of the compacted material. The ram 60 is repositioned over the domed cap 36 and downward ram pressure is reapplied. The waste materials and the domed cap 36 move downwardly into the drum 10 until the domed cap 36 is below the retaining members 26 immediately above horizontal zone 20. Due to the convexity of the domed cap 36, the downward deformation of the domed cap 36 deflects the outwardly angled lip 42 snugly against the vertical side 12, preventing material spring back at the perimeter and tending to return the outwardly angled lip 42 to the complementary angle of retaining members 26 when ram pressure is released and upwards pressure from compacted waste material attempts to uncompress or spring back.

When the ram pressure is released, the lip 42 of the domed cap 36 necessarily engages the retaining members 26 immediately above horizontal zone 20 as the domed cap 36 was compressed below the retaining members 26 and the angle between lip 42 and the retaining members 26 are complementary. The domed cap 36 is positively locked at a depth above horizontal zone 20.

Subsequent horizontal zones 22 and 24 are filled with compacted waste material in the same sequence of steps described above. The domed cap 36 which formed the top of the preceding filled horizontal zone 20 forms a new "false bottom" for horizontal zone 22. By capping the waste in each horizontal zone with a domed cap, the effect of material spring back from each preceding zone upon subsequent eliminated.

Figure 8:
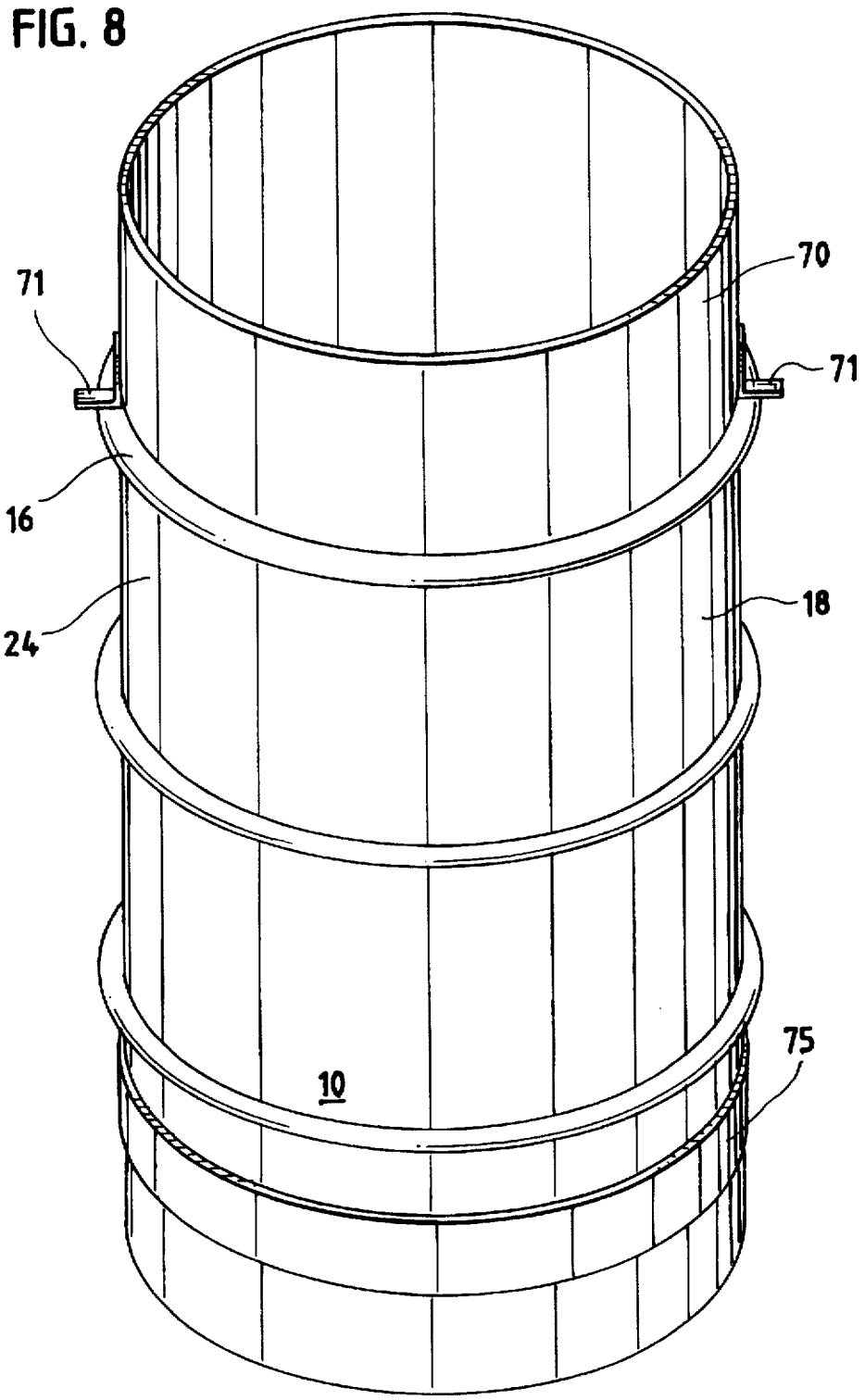
FIG. 8, is a vertical perspective view of the storage device of the invention showing the vertical container and a detachable, tubular sleeve usable therewith.

The spring back effect of the waste materials presents a special problem when filing the uppermost horizontal zone 24 in the drum 10. When filling and compacting the uppermost horizontal zone 24, the resilient waste materials will necessarily spring back up and over the top 16 of the drum 10. This problem can be solved through the use of a tubular, detachable sleeve 70 as shown in FIG. 8. The sleeve 70 is dimensioned to snugly fit within the top 16 of the drum 10. The sleeve 70 may also have angle brackets 71 on the exterior of the sleeve 70 that prevent the sleeve 70 from moving too far downward into the interior 18 of the drum 10 when the sleeve 70 is installed in the top 16 of the drum 10. The sleeve 70 will retain the waste materials that spring back over the top 16 of the drum 10 when the ram 60 is removed prior to placing a domed cap 36 on the top of the waste materials. The sleeve 70 can be installed by compacting personnel at the stage where the uppermost horizontal zone is filled with waste materials and compacted. The sleeve 70 allows for maximum final compacted density and uniformity of loading.

Under certain high pressure compacting situations, it may be desirable to include an exterior clamp band 75; as shown in FIG. 8, to reinforce the side 12 of the drum 10. The clamp band 75 would ensure the original drum shape and counteract any deformation of the final compacted drum. The bottom 14 of the drum 10 may also tend to deform under high pressure compacting. Deformation can be eliminated by means of a simple disk (not shown) being placed under the bottom 14 of the drum 10 during compacting. Preferably, the outside diameter of the disk would be slightly less than the inside diameter of the bottom 14 of the drum 10 and of a height equal to the distance between the bottom 14 of the drum 10 and the compactor floor.

Although the method of the invention has been described with reference to a vertical drum that is loaded from the top, horizontal loading and compaction are also contemplated.

The method of the invention requires no external forces, such as a means to deform the waste container to engage the lip 42 of the domed cap 36 and the retaining members 26. The design characteristics of the domed cap 36 allow enough horizontal elastic deformation on the downward ram stroke to bypass the retaining members 26 positioned above each horizontal zone without the domed cap 36 permanently deforming.

Although the present invention has been described in considerable detail with reference to certain preferred embodiments thereof, other embodiments are possible. For example, the storage container may be formed in a shape other than cylindrical. Accordingly, the wire form used in one embodiment of the invention would be formed in the alternative shape of the container. The engaging means of the domed cap and the retaining members may also be configured in an alternative arrangement that affords the same positive mechanical locking action, such as tabs engaging in a slot in the domed cap. The domed cap could also be manufactured with a generally flat profile in the center, ringed by an angled lip. This configuration would be sufficient for applications where less pressure is applied to the compacted waste material. Other modifications and variations may occur to those skilled in the art; therefore, the spirit and scope of the appended claims should not be limited to the description of the preferred embodiments contained herein.

We claim:

1. A device for maximizing the density of compacted waste comprising:

a storage container having a bottom, elongated sides, and an open top;

at least one group of distinct retaining members secured to the interior surface of the sides of the container, each group of retaining members being generally coplanar with the bottom of the storage container;

a plurality of storage zones located within the interior of the storage container, the top of each zone being defined by one group of retaining members;

at least one domed cap, each domed cap dimensioned to slidingly fit within the storage container and to cover the top of each storage zone; and means located on the edge of each domed cap for engaging the retaining members in each group of retaining members.

2. The device of claim 1 wherein the retaining members are downwardly angled tabs.

3. The device of claim 1 wherein the retaining members comprise:

a downwardly angled tab;

a hinge disposed on an end of the tab, said hinge being secured to the interior surface of the side of the container; and a spring engagingly disposed between the tab and the interior surface of the side of the container.

4. The device of claim 1 wherein the means located on the edge of each domed cap for engaging the retaining members is an upwardly and outwardly angled lip.

5. The device of claim 1 wherein each retaining member of each group of retaining members is separately mounted on the interior surface of the sides of the container.

6. The device of claim 1 wherein all of the retaining members of each group of retaining members are mounted on a separate wire form with a configuration complementary to the interior dimensions of the container, each of said wire forms being secured to the interior surface of the sides of the container.

7. The device of claim 1 where the domed cap contains vents.

8. The device of claim 1 wherein the storage container is cylindrical.

9. The device of claim 8 further comprising a tubular, detachable sleeve dimensioned to snugly fit within the top of the cylindrical storage container.

10. The device of claim 8 wherein the cylindrical storage container is a drum having at least one interior horizontal cove, and each group of retaining members is positioned adjacent the top of each horizontal cove.

11. The device of claim 10 wherein all of the retaining members of each group of retaining members are mounted on a separate wire form with a configuration complementary to the interior dimensions of the container, each of said wire forms being secured to the inter for surface of the horizontal cove.

12. A method for compacting resilient waste materials for storage and disposal in a storage container having a bottom, elongated sides and an open top, said method comprising the steps of:

(a) securing at least one group of distinct retaining members to the interior surface of the sides of the container, each group of retaining members being positioned generally coplanar with the bottom of the storage container, and each group of retaining members defining the top of one of a plurality of storage zones located within the interior of the storage container;

(b) filling the lowest unfilled storage zone of the container with resilient waste materials;

(c) compacting the waste materials;

(d) placing a domed cap on the top of the compacted waste materials, said domed cap being dimensioned to slidingly fit within the storage container and to cover the top of each storage zone, and said domed cap having engaging means located on the edge of the cap;

(e) compressing the domed cap until the domed cap is below the bottom of the group of retaining members defining the top of the uppermost filled zone;

(f) releasing the pressure on the domed cap whereby the domed cap moves upward and engages the group of retaining members defining the top of the uppermost filled zone, forming a capped layer of compacted waste; and repeating steps (b) through (f) until the storage container is filled.

13. The method of claim 12 wherein the retaining members are downwardly angled tabs.

14. The method of claim 12 wherein the retaining members comprise:

a downwardly angled tab;

a hinge disposed on an end of the tab, said hinge being secured to the interior surface of the side of the container; and a spring engagingly disposed between the tab and the interior surface of the side of the container.

15. The method of claim 12 wherein the engaging means located on the edge of each domed cap is an upwardly and outwardly angled lip.

16. The method of claim 12 wherein each retaining member of each group of retaining members is separately mounted on the interior surface of the sides of the container.

17. The method of claim 12 wherein all of the retaining members of each group of retaining members are mounted on a separate wire form with a configuration complementary to the interior dimensions of the container, each of said wire forms being secured to the interior surface of the sides of the container.

18. The method of claim 12 wherein the domed cap contains vents.

19. The method of claim 12 wherein the domed cap is compressed in step (e) by a ram having a head with a configuration complementary to the domed cap.

20. The method of claim 12 further comprising placing a hollow, detachable sleeve into the top of the storage container to contain waste materials that spring back over the top of the storage container before being capped by a domed cap, said sleeve being dimensioned to snugly fit within the top of the storage container.

21. The method of claim 12 wherein the storage container is cylindrical.

22. The method of claim 21 wherein the cylindrical storage container is a drum having at least one interior horizontal cove, and each group of retaining members is positioned adjacent the top of each horizontal cove.

23. The method of claim 22 wherein all of the retaining members of each group of retaining members are mounted on a separate wire form with a configuration complementary to the interior dimensions of the container, each of said wire forms being secured to the interior surface of the horizontal cove.

* * * * *